US011859404B2

(12) United States Patent
Yano

(10) Patent No.: US 11,859,404 B2
(45) Date of Patent: Jan. 2, 2024

(54) FIRE RESISTANT SHELTER

(71) Applicant: SHELTER JAPAN Co., Ltd., Shizuoka (JP)

(72) Inventor: Akihiko Yano, Shizuoka (JP)

(73) Assignee: SHELTER JAPAN CO., LTD., Shizuoka (JP)

( * ) Notice: Subject to any disclaimer, the term of this patent is extended or adjusted under 35 U.S.C. 154(b) by 317 days.

(21) Appl. No.: 17/601,451

(22) PCT Filed: Mar. 25, 2020

(86) PCT No.: PCT/JP2020/013183
§ 371 (c)(1),
(2) Date: Oct. 5, 2021

(87) PCT Pub. No.: WO2020/203512
PCT Pub. Date: Oct. 8, 2020

(65) Prior Publication Data

US 2022/0195747 A1 Jun. 23, 2022

(30) Foreign Application Priority Data

Apr. 5, 2019 (JP) ..... 2019-072413

(51) Int. Cl.
*E04H 9/14* (2006.01)
*E04H 9/12* (2006.01)
*E04H 9/08* (2006.01)

(52) U.S. Cl.
CPC ..... *E04H 9/14* (2013.01); *E04H 9/08* (2013.01); *E04H 9/12* (2013.01)

(58) Field of Classification Search
CPC ..... E04H 9/08; E04H 9/12; E04H 9/14
See application file for complete search history.

(56) References Cited

U.S. PATENT DOCUMENTS 3,074,080 A * 1/1963 Previti ..... E04H 9/12 109/1 S
3,114,153 A * 12/1963 Pierson ..... E04H 9/12 114/202

(Continued)

FOREIGN PATENT DOCUMENTS

CN 113605772 A * 11/2021
GB 2078272 A * 1/1982 ..... E04H 9/12

(Continued)

OTHER PUBLICATIONS

International Search Report from International Application No. PCT/JP2020/013183, dated Jun. 2, 2020.

*Primary Examiner* — Jessie T Fonseca
(74) *Attorney, Agent, or Firm* — Shih IP Law Group, PLLC.

(57) ABSTRACT

A fire resistant shelter is provided which controls a temperature of an underground evacuation space in case of a long-lasting fire. A fire resistant shelter comprises a shelter main body, a water supply device, a heat insulating housing, and a drain device. The shelter main body is made of concrete having a thickness of 30 cm and is provided with an evacuation space therein. When a fire breaks out, an evacuee escapes to the evacuation space, closes an underground door, and subsequently opens a valve of a water supply pipe through a remote operation from inside the evacuation space. This supplies water to a heat-insulating space. When water being stored up to a level corresponding to the top end of the evacuation space is confirmed, the supply of the water is stopped. At that time, the water remains at a predetermined level in a ceiling water tank.

13 Claims, 4 Drawing Sheets

(56) References Cited

U.S. PATENT DOCUMENTS 3,118,148 A * 1/1964 Taylor ..... E04H 4/088 52/63
3,138,124 A * 6/1964 Baier ..... E04H 9/12 109/1 S
4,352,260 A * 10/1982 Pearcey ..... E04B 1/3211 D25/19
4,539,780 A * 9/1985 Rice ..... E04H 9/12 D25/1
4,955,166 A * 9/1990 Qualline ..... E04H 9/12 D25/36
5,953,866 A * 9/1999 Poole ..... E04H 9/14 109/15
6,061,976 A * 5/2000 Willbanks, Jr. ..... E04H 9/12 52/169.1
6,385,920 B1 * 5/2002 Chandler ..... E04H 9/12 52/169.7
6,438,907 B1 * 8/2002 McCarthy ..... E04H 9/12 52/169.1
7,428,800 B1 * 9/2008 Vaughn ..... E04H 9/12 52/169.9
7,918,056 B2 * 4/2011 Yamaguchi ..... E02D 29/045 52/425
8,756,869 B1 * 6/2014 Routt ..... E05C 1/10 49/33
2007/0022678 A1 * 2/2007 Sempel ..... E04H 9/08 52/169.6
2007/0245644 A1 * 10/2007 Rodgers ..... E04H 9/14 52/169.6
2017/0275907 A1 * 9/2017 Brooks ..... E02D 29/045

FOREIGN PATENT DOCUMENTS

JP 53151234 U 11/1978
JP 2011-084883 A 4/2011
JP 2011-84883 A 4/2011
JP 3171235 U 10/2011
JP 2013-142237 A 7/2013

* cited by examiner

FIRE RESISTANT SHELTER

TECHNICAL FIELD

The present disclosure relates to a fire resistant shelter that suppresses a temperature rise inside an underground evacuation space with water.

BACKGROUND

In the Great Kanto Earthquake and the Great Hanshin-Awaji Earthquake, fires caused by the earthquakes, so-called earthquake fires, occurred simultaneously and caused enormous damages. Earthquake fires break out immediately after the mainshock, and the number of fires increases in proportion to the number of collapsed buildings. Further, due to combined factors such as dispersion of fire extinguishing performance, occurrence of traffic obstacles caused by building collapse and road damage, a shortage of water source caused by damage of fire hydrants and water pipes, and traffic congestion, fire extinguishing activities are hindered. This causes spread of fires and prolongs the time until fires are extinguished. In the Great East Japan Earthquake, many precious lives were lost due to one of the largest tsunamis and the resultant fires.

In the future, occurrence of an earthquake directly beneath a large city is anticipated. Such an earthquake is considered not to cause as much damage as the Great Kanto Earthquake and the Great Hanshin-Awaji Earthquake because modernization of cities has been progressed and sufficient measures have been taken. In the recent large cities, however, there are still many areas where wooden houses are built up densely, and even in a denser state than at the time of the Great Kanto Earthquake.

In case of earthquake fires that occur in densely built-up areas of wooden houses, fires spread at a high speed, and huge flames may approach frequently and simultaneously. Early evacuation is important so as not to fail to escape. However, in a case of evacuation to a safe place, it is assumed that the roads are crowded with evacuees and one is unable to go forward. Even one can go forward, it is also assumed that evacuation routes cannot be secured due to, for example, closure of roads caused by collapsed houses and collapse of bridges.

In view of the above-mentioned situation, a fire resistant shelter is required which enables evacuation easily in a short period of time when a fire breaks out and includes a means of suppressing an increase of an inside temperature of the shelter in an event of a long-lasting fire.

Patent Document 1 discloses a structure for a temporary evacuation in an event of a disaster or the like having a heat insulating layer for prevention of the disaster of the building. The structure is provided with a fire resistant structure to suppress an increase of an inside temperature at law cost so as to withstand a long-lasting fire. Specifically, an evacuation shelter comprising a ceiling wall, a side wall and a floor wall is located inside the building. A water tank is provided on the ceiling wall to suppress the increase of the inside temperature. When an ambient temperature rises due to, for example, a fire occurrence, water stored in the water tank is thrown on the shelter to prevent the increase of the inside temperature.

The shelter disclosed in Patent Document 1 is, however, installed inside the building. When the building collapses due to a fire, the collapsed building becomes a flame source and the shelter is exposed to flame heat for a long period of time. Although the temperature inside the shelter may be suppressed immediately after the water is thrown on the shelter, the temperature rise cannot be continuously suppressed for a long period of time thereafter.

CITATION LIST

Patent Literature

Patent Literature 1: JP2011-84883A

SUMMARY

Technical Problem

It is an object of the present disclosure to provide a fire resistant shelter that suppresses a temperature rise inside the shelter against a long-lasting fire.

Solution to Problem

To solve the above problem, an aspect of the present disclosure provides a fire resistant shelter that comprises a shelter main body, a heat insulating housing and a water supply device. The shelter main body includes a bottom plate, a side wall that mounts an underground door and a ceiling. The shelter main body defines an underground evacuation space. The heat insulating housing includes an elevating device and defines a heat insulating space that is capable of storing water and is connected to the underground door. The water supply device is configured to supply water to the heat insulating space. The water supply device includes a water tank for storing water and a water supply pipe for supplying the water in the water tank to the heat insulating space. A water amount capacity of the water tank is more than an amount that the water is supplied to a height of an upper surface of the underground evacuation space.

The structure enables water supply to the heat insulating space from the water supply device in case of a fire. A part or whole of the heat insulating space is filled with water having a large heat capacity. This suppresses a temperature rise of the heat insulating housing, and therefore suppresses a temperature rise of the underground evacuation space. The water supply device incudes the water tank for storing water and the water supply pipe for supplying the water that is stored in the water tank to the heat insulating space. This enables stable water supply without being affected by water failure. The water amount capacity of the water tank is more than an amount that the water having a large heat capacity is supplied to a height of an upper surface of the underground evacuation space. In case of a fire, the water is supplied from the water tank to the level corresponding to the upper surface of the underground evacuation space where the heat insulating housing is below the water level. This further suppresses the temperature rise of the underground evacuation space.

It is preferable that the water tank includes a ceiling water tank connected to the ceiling.

According to the structure, the water tank includes the ceiling water tank that is connected to the ceiling. This suppresses the temperature rise of the ceiling with the water having a large heat capacity in case of a fire.

To solve the above problem, another aspect of the present disclosure provides a fire resistant shelter that comprises a shelter main body, a heat insulating housing and a water supply device. The shelter main body includes a bottom plate, a side wall that mounts an underground door and a ceiling. The shelter main body defines an underground evacuation space. The heat insulating housing includes an elevating device and defines a heat insulating space that is capable of storing water and is connected to the underground door. The water supply device is configured to supply water to the heat insulating space. The water supply device includes a water tank for storing water and a water supply pipe for supplying the water in the water tank to the heat insulating space. The water tank includes a ceiling water tank that is connected to the ceiling.

The structure enables water supply to the heat insulating space from the water supply device in case of a fire. A part or whole of the heat insulating space is filled with water having a large heat capacity. This suppresses a temperature rise of the heat insulating housing, and therefore suppresses a temperature rise of the underground evacuation space. The water supply device incudes the water tank for storing water and the water supply pipe for supplying the water that is stored in the water tank to the heat insulating space. This enables stable water supply without an affect of water failure. The water tank includes the ceiling water tank that is connected to the ceiling. This suppresses the temperature rise of the ceiling with the water having a large heat capacity in case of fire.

It is preferable that a predetermined water level of the ceiling water tank is maintained when the water is supplied to a level that is higher than a height of an upper surface of the underground evacuation space.

According to the structure, the predetermined water level of the ceiling water tank is maintained when the water is supplied to the level that is higher than the height of the upper surface of the underground evacuation space. This suppresses the temperature rise of the ceiling due to flame heat.

It is preferable that the fire resistant shelter further comprises a drain device that is configured to drain the water stored in the heat insulating space to outside.

In the water stored condition of the heat insulating space, it is difficult to open and close the underground door by an influence of a water pressure. When the underground door is opened, the water enters in the evacuation space. This structure includes the drain device that is configured to drain the water stored in the heat insulating space to outside. The drain device discharges the water stored in the heat insulating space. This enables easy opening of the underground door and prevents water leakage in the evacuation space.

It is preferable that the ceiling heat insulating member having a thickness of 0.8 to 1.2 m is provided between the ceiling and the evacuation space.

According to the structure, the ceiling heat insulating member having a thickness of 0.8 to 1.2 m which is thicker than a normal heat insulating member is provided on the ceiling where the temperature rise inside the shelter main body is likely due to an influence of flame heat. This suppresses the temperature rise inside the underground evacuation shelter.

It is preferable that a side heat insulating member having a thickness of 0.8 to 1.2 m is provided between the side wall in contact with the heat insulating space and the evacuation space.

According to the structure, the side heat insulating member having a thickness of 0.8 to 1.2 m is provided inside the shelter main body in proximity to the heat insulating space where the temperature rise is likely due to an influence of flame heat. This suppresses the temperature rise inside the underground evacuation space.

It is preferable that the bottom plate, the side wall, the ceiling, and the underground door are made of concrete having a thickness of 0.3 to 0.5 m.

According to the structure, the underground evacuation space is provided in the shelter main body that is made of concrete having a thickness of 0.3 to 0.5 m with a predetermined radiation shielding performance.

DESCRIPTION OF EMBODIMENTS

Figure 1:
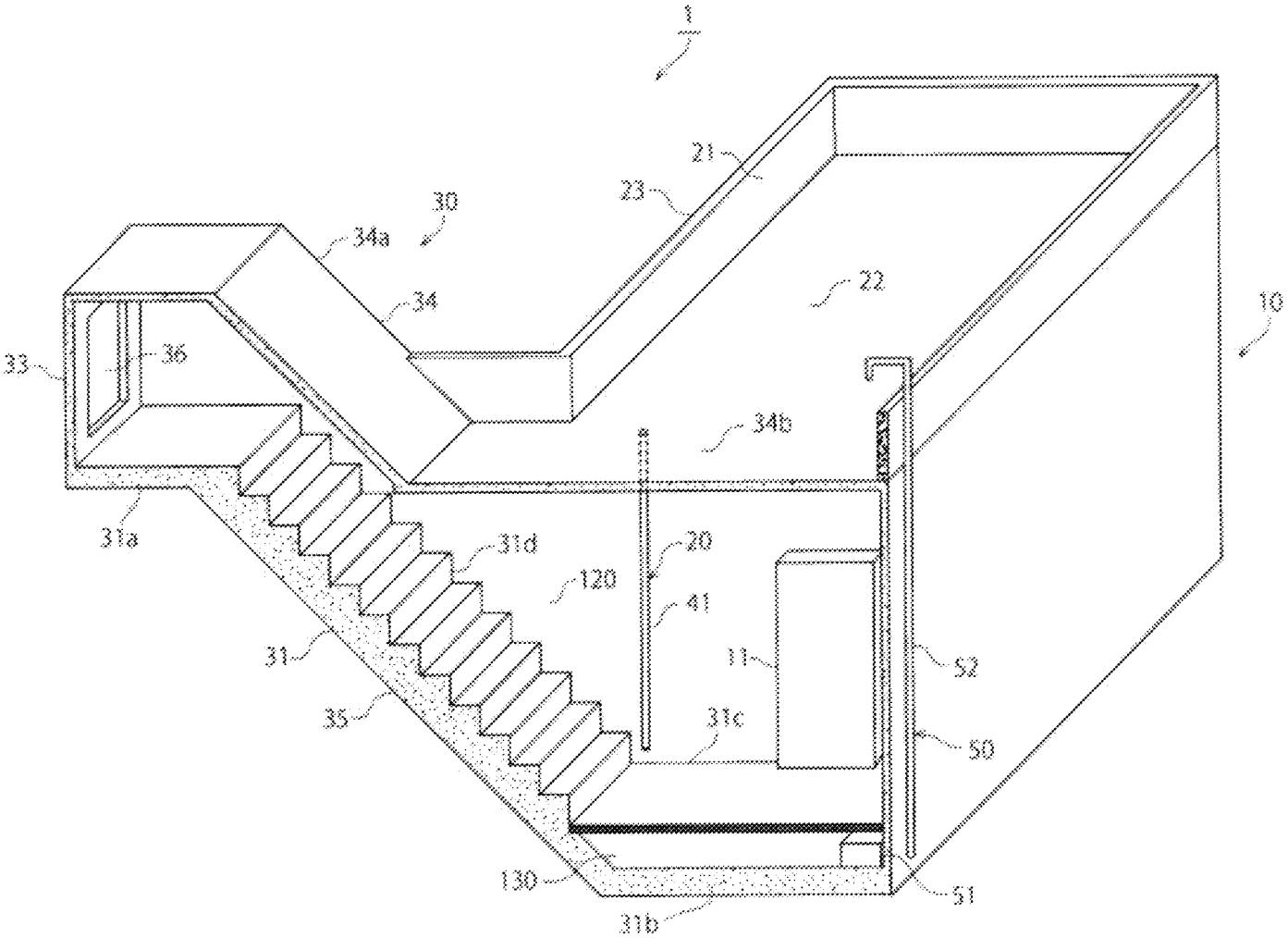
FIG. 1 is a perspective cross-sectional view illustrating a fire resistant shelter according to an embodiment.

An embodiment of the present disclosure will now be described with reference to the drawing.

As shown in FIG. 1, a fire resistant shelter 1 includes a shelter main body (hereinafter referred to as the main body 10), a water supply device 20, a heat insulating housing 30 and a drain device 50.

Figure 2A:
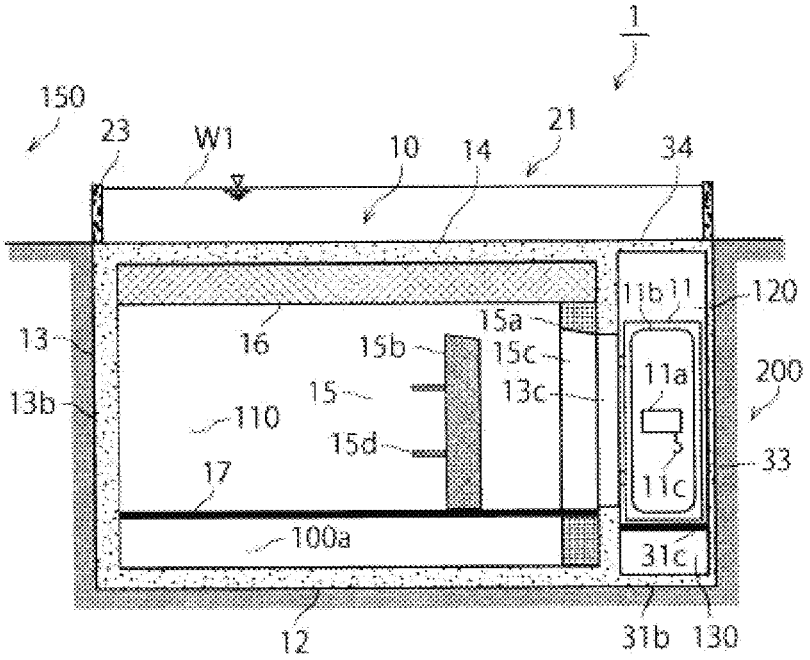
FIG. 2(*a*) is a side cross-sectional view showing a water storage condition of a water tank, and FIG. 2(*b*) is a side cross-sectional view showing a water in the water tank being supplied to a heat insulating space in case of a fire.
Figure 2B:
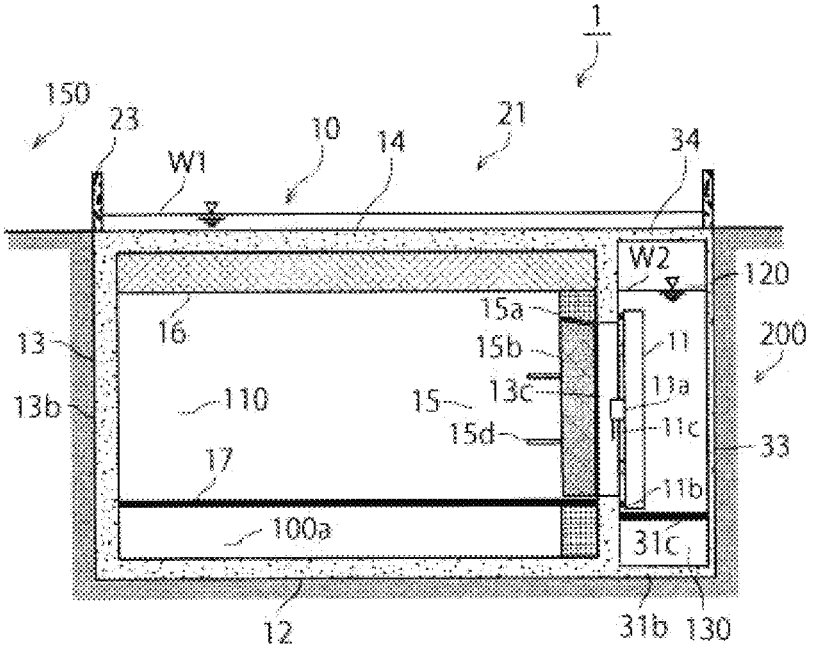

As shown in FIGS. 2(*a*) and 2(*b*), the main body 10 is a housing having a bottom plate 12, a side wall 13, a ceiling 14 and an underground door 11 which are made of a concrete plate having a thickness of 30 cm. An inside of the main body 10 is provided with a floor 17, a side heat insulating member 15 and a ceiling heat insulating member 16. The side wall 13, the floor 17, the side heat insulating member 15 and the ceiling heat insulating member 16 jointly define an underground evacuation space 110 (hereinafter referred to as the evacuation space 110).

The concrete-made structure includes concrete as a main material, and specifically refers to, for example, an unreinforced concrete structure, reinforced concrete structure, composite structure of a steel plate and concrete. The concrete is a material having a high radiation shielding performance. The concrete has a thickness equal to or larger than a thickness capable of withstanding an assumed load (for example, 30 cm) in the embodiment to have a predetermined radiation shielding performance. A thickness of the main body 10 is preferably between 0.3 to 0.5 m. A concrete material is preferably ordinary concrete or heavy concrete. When the heavy concrete is used, a higher radiation shielding performance than the ordinary concrete is provided.

The evacuation space 110 refers to a space that is defined inside the main body 10 and is partially or wholly located in an underground 200. Preferably, the entire evacuation space 110 is located in the underground 200. More preferably, the entire main body 10 is located in the underground 200. This reduces an influence of flame heat and suppresses a temperature rise of the evacuation space 110.

Figure 3A:
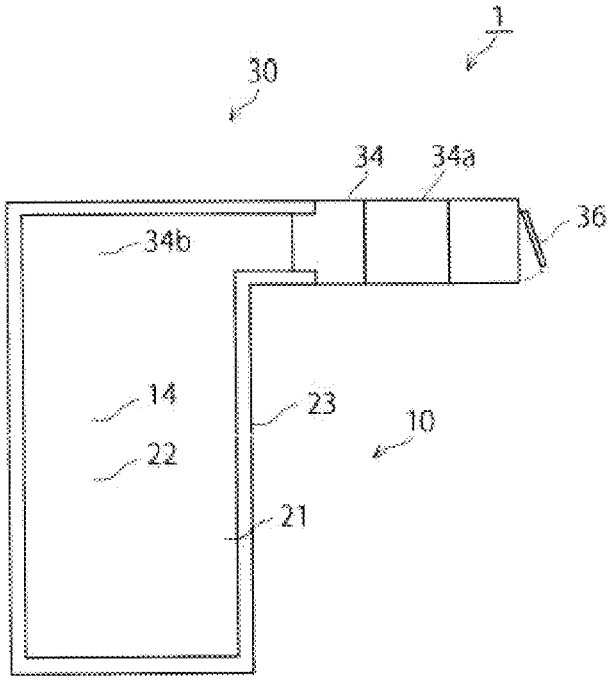
FIG. 3(*a*) is a plain view of the same, and FIG. 3(*b*) is a plain cross-sectional view of the same.
Figure 3B:
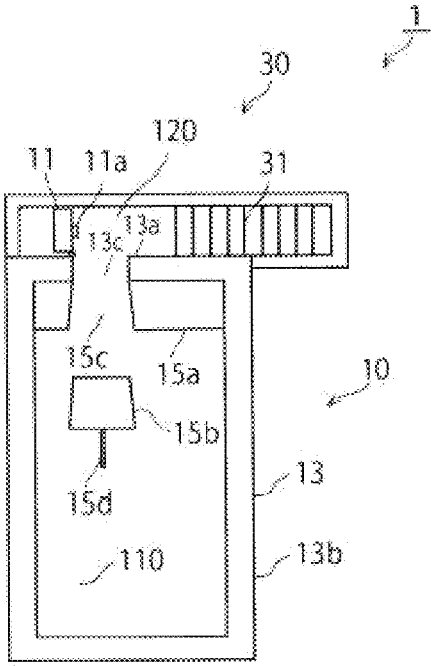

As shown in FIG. 3(*b*), the side wall 13 includes an underground side wall 13*b* having a U-shape in a plan view which are partially or wholly in contact with the underground 200 and a heat insulating side wall 13*a* which is connected to each end of the underground side wall 13*b* and in contact with a heat insulating space 120. An underground door 11 is attached to the heat insulating side wall 13*a* and an opening 13*c* is formed for the passage between the heat insulating space 120 and the evacuation space 110.

As shown in FIG. 3(*b*), the underground door 11 is an outward-opening door provided on the heat insulating side wall 13*a*, which is open in peacetime and closed in evacuating to the evacuation space 110. This enables evacuation into the evacuation space 110 without opening a heavy door. As shown in FIG. 2(*a*), the underground door 11 is provided with an annular packing 11*b* on a surface facing an outer periphery of the opening 13*c*. This ensures watertightness, so that water W2 can be prevented from entering the evacuation space 110 when the water W2 is stored in the heat insulating space 120. Further, a winch 11*a* which is used for closing the underground door 11 is arranged in a middle portion of the underground door 11 on the evacuation space 110 side. A hook 11*c* is attached to an end of the winch 11*a*.

Figure 4B:
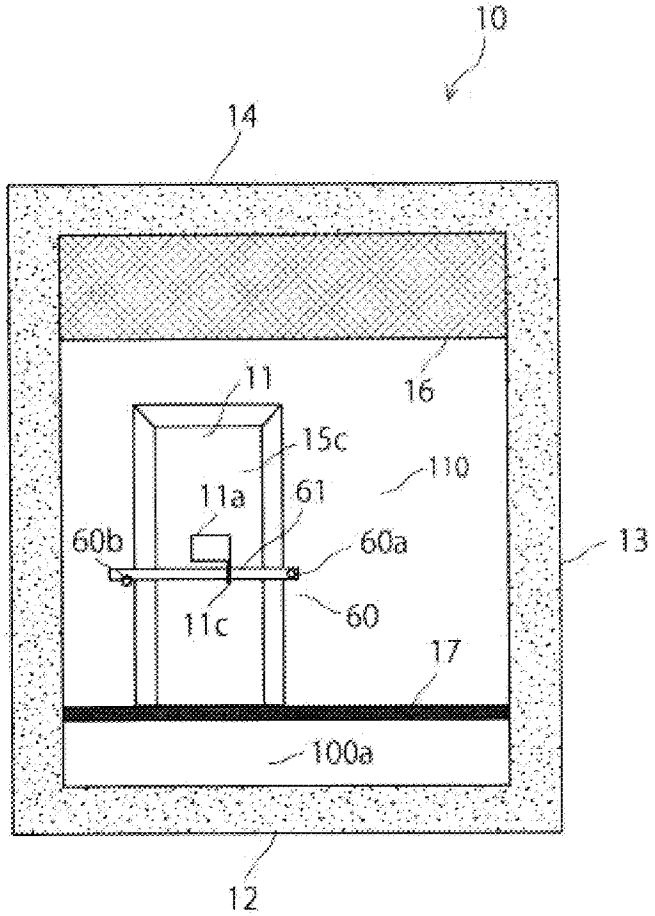
FIG. 4(*a*) and FIG. 4(*b*) are a diagram illustrating a procedure of closing an underground door of the embodiment.
Figure 4A:
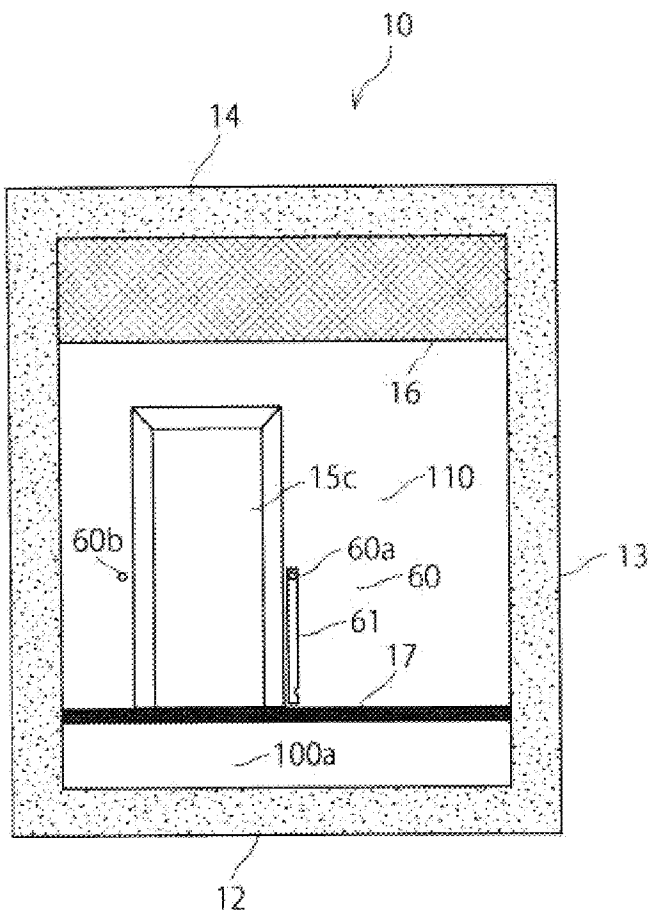

As shown in FIGS. 4(*a*) and 4(*b*), an anchor device 60 to which the hook 11*c* can be attached is provided in the vicinity of a heat insulating opening 15*c*. The anchor device 60 has projecting members 60*a* and 60*b* projecting toward the evacuation space 110, and a bar 61. The projecting members 60*a* and 60*b* are arranged opposite with each other across the heat insulating opening 15*c*. One end of the bar 61 is rotatably fixed to the projecting member 60*a*, and the other end of the bar 61 is removable from the projecting member 60*b*.

A closing process of the underground door 11 will now be described.

As shown in FIG. 4(*a*), the underground door 11 is in an open state and the bar 61 is supported by the projecting member 60*a* while hanging down in peacetime. When a fire breaks out, as shown in FIG. 4(*b*), an evacuee evacuates to the evacuation space 110 while holding the hook 11*c* in his hand, and rotates the bar 61 to fix to the projecting member 60*b*. The bar 61 is fixed to the heat insulating side wall 13*a* through the projecting members 60*a* and 60*b* in a state of horizontally crossing the heat insulating opening 15*c*. The underground door 11 is closed by attaching the hook 11*c* to the bar 61 and winding up the winch 11*a*.

The underground door 11 is partially or wholly located in the underground 200. Preferably, the entire underground door 11 is located in the underground 200. This reduces an influence of flame heat and suppresses a temperature rise of the evacuation space 110.

A floor 17 is provided at substantially the same height as a lower end of the opening 13*c*. This provides a storage space 100*a* between the bottom plate 12 and the floor 17. The storage space 100*a* is provided with equipment necessary for evacuation such as emergency supplies and cots, which enables secure and comfortable evacuation. Further, steps between the opening 13*c* and the heat insulating opening 15*c* and the floor 17 is eliminated. This enables easy evacuation of a person having a disability with his legs to the evacuation space 110 with a wheelchair.

A ceiling heat insulating member 16 having a thickness of 1.0 m is arranged inside the main body 10 in a state where the upper end is in contact with the ceiling 14 and the outer periphery is in contact with the heat insulating side wall 13*a* and the underground side wall 13*b*. The thickness of the ceiling heat insulating member 16 is preferably 0.8 m to 1.2 m. By providing a heat insulating material that is thicker than a normal thickness, a temperature rise of the evacuation space 110 due to an influence of flame heat is suppressed.

A preferable example of a material of the ceiling heat insulating member 16 is a fiber-based heat insulating material such as glass wool, cellulose fiber, wool heat insulating material or rock wool, or a foamed plastic heat insulating material such as hard urethane foam, beaded polystyrene foam, or phenol foam. A foamed plastic heat insulating material, which is lightweight and has an excellent resistance to moisture permeation, is more preferable. This reduces the weight and prevents an increase of the weight or a change of the shape due to moisture absorption when left in the highly humid main body 10 for a long time. Further, a heat insulating member that is made of lightweight cellular concrete may be adopted to abut on the ceiling 14 as a first layer to form a two-layer structure. This prevents a second layer of the heat insulating member being deformed when the ceiling 14 becomes hot due to flame heat.

A side heat insulating member 15 having a thickness of 1.0 m is arranged inside the main body 10 in contact with the heat insulating side wall 13*a*. The side heat insulating member 15 has a wall heat insulating member 15*a* and an opening heat insulating member 15*b*. The wall heat insulating member 15*a* and the opening heat insulating member 15*b* each have an inclined contact surface whose diameter increases from the outside to the inside on the upper surface portion and the side surface portion. A thickness of the side heat insulating member 15 is preferably 0.8 m to 1.2 m. The heat insulating material that is thicker than the normal thickness suppresses the temperature rise of the evacuation space 110 due to the influence of flame heat.

The wall heat insulating member 15*a* has a heat insulating opening 15*c* that is formed in a region corresponding to the opening 13*c*, and is arranged inside the main body 10 in contact with the heat insulating side wall 13*a*, the underground side wall 13*b*, and the bottom plate 12. This suppresses the temperature rise of the evacuation space 110 when the internal temperature of the heat insulating space 120 rises due to the influence of flame heat.

The opening heat insulating member 15*b* is provided for inserting into the heat insulating opening 15*c*. The opening heat insulating member 15*b* and the heat insulating opening 15*c* correspond in shape to each other, and both have a shape that expands from the outside to the inside toward the evacuation space 110. This facilitates the insertion of the opening heat insulating member 15*b* into the heat insulating opening 15*c*. Further, the opening heat insulating member 15*b* is attached with a handle 15*d* for hand gripping.

A preferable example of a material of the side heat insulating member 15 is a fiber-based heat insulating material such as glass wool, cellulose fiber, wool heat insulating material or rock wool, or a foamed plastic heat insulating material such as hard urethane foam, beaded polystyrene foam or phenol foam. A foamed plastic heat insulating material that is lightweight and has an excellent resistance to moisture permeation is more preferable. This reduces the weight and prevents an increase of the weight or a change of the shape due to moisture absorption when left in the highly humid main body 10 for a long time, As shown in FIG. 1, the water supply device 20 has a ceiling water tank 21 and an upwardly extending water supply pipe 41. Water W1 is stored in a recess that is open upward of the ceiling water tank 21. The water W1 is supplied to the heat insulating space 120. As shown in FIG. 3(*a*), the ceiling water tank 21 has a tank wall 23.

The tank wall 23 extends vertically from an end of a tank bottom surface 22 having a L shape in a plan view including the ceiling 14 and a horizontal roof 34*b*, and the end of the tank wall 23 is connected to an inclined roof 34*a*. The tank wall 23 is made of concrete and preferably has a structural thickness enough to withstand an assumed external force such as seismic force and water pressure. Specifically, the tank wall 23 does not need to have a thickness to exhibit a predetermined radiation shielding performance.

As shown in FIG. 2(*b*), it is preferable that a water amount capacity of the ceiling water tank 21 is an amount that the water W2 is supplied to the heat insulating space 120 to a height of an upper surface of the underground evacuation space 110, plus an amount that evaporates due to the influence of flame heat. That is, the water level of the ceiling water tank 21 after supplying the water W2 to the heat insulating space 120 preferably corresponds to the water level at which the water W1 remains in the ceiling water tank 21 even after the water W1 is evaporated due to the influence of flame heat. The reason will be described below.

When a temperature of an outside space 150 greatly exceeds 100° C. due to the influence of flame heat, the water W1 stored in the ceiling water tank 21 boils and evaporates. The temperature of the ceiling 14 does not exceed 100° C. due to the latent heat effect of the water W1 at that time. This leads to suppression of the temperature of the evacuation space 110.

As shown in FIG. 1, the water supply pipe 41 has a valve (not shown) that is opened and closed by remote control from the evacuation space 110. The water supply pipe 41 is connected to the ceiling water tank 21 at one end, extends downward along the surface of the heat insulating side wall 13*a* on the insulation space 120 side, and is located above the housing deck 31*c* at the other end. The water W1 stored in the ceiling water tank 21 is supplied to the heat insulating space 120 by remote control from the evacuation space 110.

The water supply pipe 41 may be arranged through the evacuation space 110, and a manual or automatic valve may be provided in the evacuation space 110.

The heat insulating housing 30 has a staircase 31 (elevating device), a housing side wall 33, and a roof 34, all of which jointly define the heat insulating space 120 where water can be stored. The heat insulating space 120 is connected to the underground door 11. The heat insulating side wall 13*a* and the underground door 11 are connected to the outside space 150 through the heat insulating space 120 and are more susceptible to flame heat than the underground side wall 13*b*. The heat insulating housing 30 is formed to suppress a temperature rise of the heat insulating side wall 13*a* and the underground door 11 due to the influence of flame heat.

The upper end of the staircase 31 is provided with a landing 31*a* having a rectangular shape in a plan view, and a lower end is provided with a stair bottom plate 31*b* having a rectangular shape in a plan view and extending horizontally from the bottom plate 12 of the main body 10, and a housing deck 31*c* is arranged on the stair bottom plate 31*b*. The landing 31*a* and the stair bottom plate 31*b* are connected via a slope 35 having a step 31*d*. The housing deck 31*c* is provided to make the step with the floor 17 as small as possible. This facilitates the passage of people having disabilities with their legs. A water supply space 130 is provided between the stair bottom plate 31*b* and the housing deck 31*c*.

The housing side wall 33 extends vertically upward from an outer end of the staircase 31, and a part of the housing side wall 33 protrudes into the outside space 150. A steel outer door 36 is provided on the part of the housing side wall 33 that protrudes into the outside space 150.

A roof 34 is connected to an upper end of the housing side wall 33, and has a horizontal roof 34*b* and an inclined roof 34*a*. The horizontal roof 34*b* extends horizontally from an end of the ceiling 14 that is connected to the heat insulating side wall 13*a*. The horizontal roof 34*b* cooperates with the ceiling 14 to form a tank bottom surface 22 of the ceiling water tank 21. The inclined roof 34*a* extends obliquely upwardly from one end of the horizontal roof 34*b*, bends and extends horizontally, and is connected to the housing side wall 33 that is provided with the outer door 36. A vertical distance between the inclined roof 34*a* and the staircase 31 is preferably set to a height that allows the passage of evacuees without any inconvenience.

The heat insulating housing 30 is made of concrete, and preferably has a structural thickness enough to withstand an assumed external force such as seismic force and water pressure. Specifically, the heat insulating housing 30 does not need to have a thickness to exhibit a predetermined radiation shielding performance.

The drain device 50 has a drain pump 51 and a drain pipe 52. The drain pump 51 is adapted to drain the water W2 stored in the heat insulating space 120 and is arranged in the water supply space 130. The water supply space 130 and the heat insulating space 120 communicate with each other. This allows the water W2 to be drained without remaining on the upper surface of the housing deck 31*c*. The drain pipe 52 is connected to the drain pump 51, and is arranged so that its end is located directly above the ceiling water tank 21 through the underground 200 and the outside space 150. This enables the water W2 to be returned to the ceiling water tank 21.

The following describes a process of evacuation to the fire resistant shelter 1.

When a fire breaks out, an evacuee releases the closed outer door 36, enters the heat insulating space 120 in the heat insulating housing 30 from the outside space 150, and evacuates to the evacuation space 110 through the staircase 31. The open underground door 11 is closed according to the process described above.

After the closure of the underground door 11 is confirmed, the valve of the water supply pipe 41 is released by remote control from the evacuation space 110. The water W1 stored in the ceiling water tank 21 is supplied to the heat insulating space 120. After being confirmed that the water W2 is stored up to a level corresponding to the height of the upper end of the evacuation space 110, the valve of the water supply pipe 41 is closed to stop the supply of the water W1.

At that time, the water W1 remains in the ceiling water tank 21 at a predetermined height. The upper surface of the ceiling 14 is covered with the water W1 and is not in direct contact with the flame. Further, a temperature rise of the ceiling 14 is suppressed due to the latent heat effect when the stored water W1 evaporates.

The temperature rise of the heat insulating side wall 13*a* due to flame heat is suppressed by the latent heat effect when the water W2 stored in the heat insulating space 120 evaporates, etc., and the temperature rise of the underground side wall 13*b* due to flame heat is suppressed because the underground side wall 13*b* is buried in the underground 200 where the influence of flame heat is relatively small.

After the extinguishment of the fire is confirmed, the drain pump 51 is operated from the evacuation space to discharge the water W2 to the outside space 150 and return it to the ceiling water tank 21.

After confirming the drop of the level of the water W2, the evacuee manually releases the underground door 11 and escapes to the outside space 150.

The present disclosure is not limited to the above-described embodiment but various modifications, substitutions, and the like may be made without departing from the technical idea of the present disclosure. For example, in the embodiment, the single ceiling water tank 21 is provided as the water tank for storing the water W1, but a plurality of water tanks may be provided.

The elevating device is the staircase 31, but may use a lift that moves along the slope of the staircase 31 together. This makes it easier for people having disabilities with their legs to go up and down. Further, the staircase 31 may be replaced with an elevator, or the staircase 31 and the elevator may be used together.

The staircase 31 extends parallel to a side direction of the heat insulating side wall 13*a* in a plan view, but the extending direction may not be limited to this direction. That is, the staircase 31 may be arranged without being limited to the direction. The staircase 31 may also be a spiral staircase. This allows the fire resistant shelter 1 to be arranged efficiently in site.

The ceiling water tank 21 may be used in various ways. For example, a steel deck may be provided above the ceiling water tank 21 and the deck may be used as a parking lot. The ceiling water tank 21 may also be used as a pool and lit up with LED lighting facilities to enjoy the night view. Further, the ceiling water tank 21 may be used as a Japanese garden-style facility to grow ornamental fish such as Nishikigoi.

INDUSTRIAL APPLICABILITY

The fire resistant shelter according to the present disclosure can be located in site to enable evacuation in a short period of time. The fire resistant shelter suppresses the temperature rise inside the evacuation space in case of a long-lasting fire, which enables long-term evacuation. The fire resistant shelter can also be used as a nuclear shelter. The industrial applicability is therefore high.

REFERENCE SIGNS LIST

1 . . . fire resistant shelter
10 . . . shelter main body
11 . . . underground door
12 . . . bottom plate
13 . . . side wall
14 . . . ceiling
15 . . . side heat insulating member
16 . . . ceiling heat insulating member
20 . . . water supply device
21 . . . ceiling water tank
30 . . . heat insulating housing
31 . . . staircase (elevating device)
41 . . . water supply pipe
50 . . . drain device
110 . . . underground evacuation space
120 . . . heat insulating space
150 . . . outside space
W1, W2 . . . water

The invention claimed is:

1. A fire resistant shelter, comprising:

a shelter main body having a bottom plate, a side wall that attaches an underground door and a ceiling, the shelter main body defining an underground evacuation space;

a heat insulating housing having an elevating device and defining a heat insulating space that is capable of storing water and is connected to the underground door; and a water supply device that is configured to supply water to the heat insulating space, wherein the water supply device includes a water tank for storing water and a water supply pipe for supplying the water in the water tank to the heat insulating space, and a water amount capacity of the water tank is more than an amount that the water is supplied to a height of an upper surface of the underground evacuation space.

2. The fire resistant shelter according to claim 1, wherein the water tank includes a ceiling water tank that is connected to the ceiling.

3. The fire resistant shelter according to claim 2, wherein a predetermined water level of the ceiling water tank is maintained when the water is supplied to a level that is higher than a height of an upper surface of the underground evacuation space.

4. The fire resistant shelter according to claim 1, further comprising a drain device that is configured to drain the water stored in the heat insulating space to outside.

5. The fire resistant shelter according claim 1, wherein a ceiling heat insulating member having a thickness of 0.8 to 1.2 m is provided between the ceiling and the evacuation space.

6. The fire resistant shelter according to claim 1, wherein a side heat insulating member having a thickness of 0.8 to 1.2 m is provided between the side wall in contact with the heat insulating space and the evacuation space.

7. The fire resistant shelter according to claim 1, wherein the bottom plate, the side wall, the ceiling, and the underground door are made of concrete having a thickness of 0.3 to 0.5 m.

8. A fire resistant shelter, comprising:

a shelter main body having a bottom plate, a side wall that attaches an underground door and a ceiling, the shelter main body defining an underground evacuation space;

a heat insulating housing having an elevating device and defining a heat insulating space that is capable of storing water and is connected to the underground door; and a water supply device that is configured to supply water to the heat insulating space, wherein the water supply device includes a water tank for storing water and a water supply pipe for supplying the water in the water tank to the heat insulating space, and the water tank includes a ceiling water tank that is connected to the ceiling.

9. The fire resistant shelter according to claim 8, wherein a predetermined water level of the ceiling water tank is maintained when the water is supplied to a level that is higher than a height of an upper surface of the underground evacuation space.

10. The fire resistant shelter according to claim 8, further comprising a drain device that is configured to drain the water stored in the heat insulating space to outside.

11. The fire resistant shelter according to claim 8, wherein a ceiling heat insulating member having a thickness of 0.8 to 1.2 m is provided between the ceiling and the evacuation space.

12. The fire resistant shelter according to claim 8, wherein a side heat insulating member having a thickness of 0.8 to 1.2 m is provided between the side wall in contact with the heat insulating space and the evacuation space.

13. The fire resistant shelter according to claim 8, wherein the bottom plate, the side wall, the ceiling, and the underground door are made of concrete having a thickness of 0.3 to 0.5 m.

* * * * *